US005827083A

United States Patent [19]

Dullin

[11] Patent Number: 5,827,083

[45] Date of Patent: Oct. 27, 1998

[54] ELECTRICAL CONNECTOR

[75] Inventor: Claus Dullin, Ilsfeld, Germany

[73] Assignee: Amphenol-Tuchel Electronics GmbH, Heilbronn, Germany

[21] Appl. No.: 958,212

[22] Filed: Oct. 27, 1997

Related U.S. Application Data

[63] Continuation of Ser. No. 584,385, Jan. 11, 1996, abandoned.

[30] Foreign Application Priority Data

Jan. 14, 1995 [DE] Germany ..... 195 00 959.2

[51] Int. Cl.[6] ..... H01R 29/00

[52] U.S. Cl. ..... 439/188

[58] Field of Search ..... 439/188, 352–357, 439/488, 489, 507, 510; 200/51.09

[56] References Cited

U.S. PATENT DOCUMENTS

| | | |
|---|---|---|
| 4,196,956 | 4/1980 | Hoffman . |
| 5,288,242 | 2/1994 | Muzslay . |
| 5,314,345 | 5/1994 | Cahaly et al. . |

FOREIGN PATENT DOCUMENTS

| | | |
|---|---|---|
| 0 591 947 | 4/1994 | European Pat. Off. . |
| 0 591 948 | 4/1994 | European Pat. Off. . |
| 43 17 344 | 12/1994 | Germany . |

*Primary Examiner*—Khiem Nguyen
*Attorney, Agent, or Firm*—Bacon & Thomas

[57] ABSTRACT

The invention concerns an electrical connector, in particular for use between a socket (46) and an electrical control device, for inflatable restraining systems in motor vehicles. The connector has a housing (10,12) for accommodating electrical cables (28), as well as contact springs (24) connected to said cables, the contact springs serving to accommodate contact pins (50) of the associated socket with priming cap (trigger device); spring locking arms (42*a,b*) on the housing for attaching the housing to the socket; and a locking element (16) which, after insertion in a corresponding housing opening (56), secures the locking arms against unintentional release and in the locking position releases a short-circuiting link (52) between the contact pins of the socket, the locking arms being coupled to flexible housing sections (38*a,b*) in the direction of movement of the locking arms.

13 Claims, 2 Drawing Sheets

ELECTRICAL CONNECTOR

This application is a continuation of U.S. patent application Ser. No. 08/584,385 filed on Jan. 11, 1996 now abandoned.

BACKGROUND OF THE INVENTION

The invention concerns an electrical connector, in particular for use between a generator (a socket) and an electrical control device, for inflatable restraining systems in motor vehicles.

DESCRIPTION OF RELATED ART

Such a connector is disclosed in EP 0 591 948 A2. A connector of the type described has a very limited size (for example length: 2–3 cm, width: approx. 1 cm, height: 0.1 to 10 cm). It follows from this that the locking arms for localizing the housing at the socket have a length of only a few millimeters, with the result that their "spring force" is very limited. Difficulties arise when assembling the connector with an associated socket. The locking force is relatively high, which makes both manual and machine assembly more difficult.

Connectors for the field of application described above are also described in EP 0 591 947 A2 and DE 43 17 344 A1.

SUMMARY OF THE INVENTION

The object of the invention is to develop a connector of the type described, so that the mating force required for assembly with an associated socket, and correspondingly the force for possible release, is minimised. Furthermore, the handling of the connector should generally be improved.

According to the invention, this is achieved in a connector having the features stated in the preamble of claim 1, in that the locking arms are coupled to housing sections which are flexible in the direction of movement of the locking arms. A direct result of this is that not only the (minimal) spring action of the locking arms but above all the elastic properties of the housing sections to which the locking arms are coupled, serve to minimise the mating and release force. Here the corresponding flexible housing sections are either flex automatically when the locking arms are inserted, or they can also be additionally acted upon manually in order to effect the insertion or release of the locking means with the smallest possible insertion or release force.

Provision is made in an exemplary embodiment for the flexible housing sections to be of bridge-like form and connected to the associated housing part only at their end regions. In this manner, the flexible housing sections take on the function of a "mechanical bypass", which makes their bridge-like character immediately clear.

Also it is also possible to couple the flexible housing sections to the associated housing part at one end only, thereby further increasing the elasticity (flexibility) of the corresponding housing sections.

Particularly easy handling is then achieved if the flexible housing sections extend either side of the associated housing part and run more or less parallel to the electrical cables. In the case of manual insertion or release, the opposing flexible housing sections can be pressed together with two fingers, for example, so that the spacing of the associated locking arms is reduced accordingly and the electrical connector can be introduced into the socket with practically no friction, until the desired end position is reached. Following this, the pressure force is removed so that the locking hooks of the locking arms spring back behind the corresponding locking sections of the socket by neutralizing their preloading and facilitating secure locking of both parts. The same also applies when fitting is by mechanical means.

In a further development, the invention provides for the housing to be made in three parts, that is with a lower housing part to accommodate the contact springs, an upper housing part to cover the lower housing part and to localise the electrical cables between the upper and lower housing part, as well as the locking element that can be led through a corresponding opening in the upper housing part.

During the manufacture of the connector, which can for example be designed as a plastic injection moulded part, the upper housing part and/or the looking element can initially be connected to the lower housing part via flexible straps. For assembly, the upper housing part and locking element are suitably folded over, the straps being either incorporated or broken or cut off prior to or during assembly.

The flexible housing sections as described in detail above, are in this case preferably coupled to the lower part of the housing. The description of the figures below illustrates an exemplary embodiment.

At the same time, the form of the connector as described makes it possible to provide further constructive features to make the handling of the connector easier, especially during its preparation or assembly, respectively. According to one exemplary embodiment, it is proposed to construct the upper housing part with a section projecting in the direction of the lower housing part which, in the assembled position (after folding over by approximately 180°) acts upon the upper end of the contact springs and in the process takes over the function of a holding-down device for the contact springs. During the assembly of the connector and its connection to a socket, the contact springs are held in position in a totally secure manner by this means. This is therefore very important because the known feature of a short-circuiting link is of considerable importance and the feature as described ensures that unintentional release of the short-circuiting link from the contact pins of the socket (for example during assembly) does not occur. If the upper housing part has at least one recess adjacent to the locking element (in the assembled position), then release of the locking element is additionally made easier by this feature. A tool can be very easily passed through the opening to release the locking element, while in turn the housing can be easily released from the socket by pressure on the flexible housing sections—as illustrated.

In this case, the locking element can itself have a particularly stable form in order to ensure high insertion force in the inserted state. According to an exemplary embodiment, the locking element has a U-shape and said opening then lies in the region between the U-shaped limbs.

Due to this arrangement, additional locking means can be provided on the locking element, for example outward-protruding enlargements at the free end section of the locking element for engaging in a corresponding recess in the short-circuiting link.

This can for example consist of a leaf spring that is clamped at one end in the socket and whose short-circuiting end is angled in relation to the spring part of the short-circuiting link. The following description of an exemplary embodiment also includes additional explanations.

The housing part accommodating the contact springs is constructed for example in the form of a nozzle. To eliminate incorrect assembly, a further feature of the invention provides for the nozzle-like housing part to be constructed with at least one radially-projecting rib for engagement in a corresponding slot in the socket. The individual components can therefore only be connected together in the correct manner.

Finally, the multi-part construction of the housing also enables a multi-part, in particular a two-part, ferrite core enclosing the electric cables to be constructed, one section of the ferrite core being positioned in the upper housing part and the other section of the ferrite core being positioned in the lower housing part. In principle it would be possible to construct the ferrite core in one piece and provide through-holes for the cables, which then, however, would have to be "threaded" in and through the ferrite core. By comparison, the two-part embodiment provides considerable assembly advantages because the cables can be laid in a semicircular opening of one section of the ferrite core (in the lower housing part) and the ferrite core is only sealed during assembly via the other section of the ferrite core located in the upper housing part. In this case, in order to construct a completely sealed ferrite core, corresponding slot/spring arrangements can be formed at the contact faces, which at the same time optimises the contact surface between the two sections of the ferrite core and with it the EMP (electronic magnetic pulse) protection or electromagnetic compatibility, respectively.

Further features of the invention are revealed in the features of the sub-claims, as well as the other application documents. In this respect, the following description of an exemplary embodiment includes general features and should not be interpreted as limiting in any way.

DETAILED DESCRIPTION OF THE INVENTION

Figure 1:
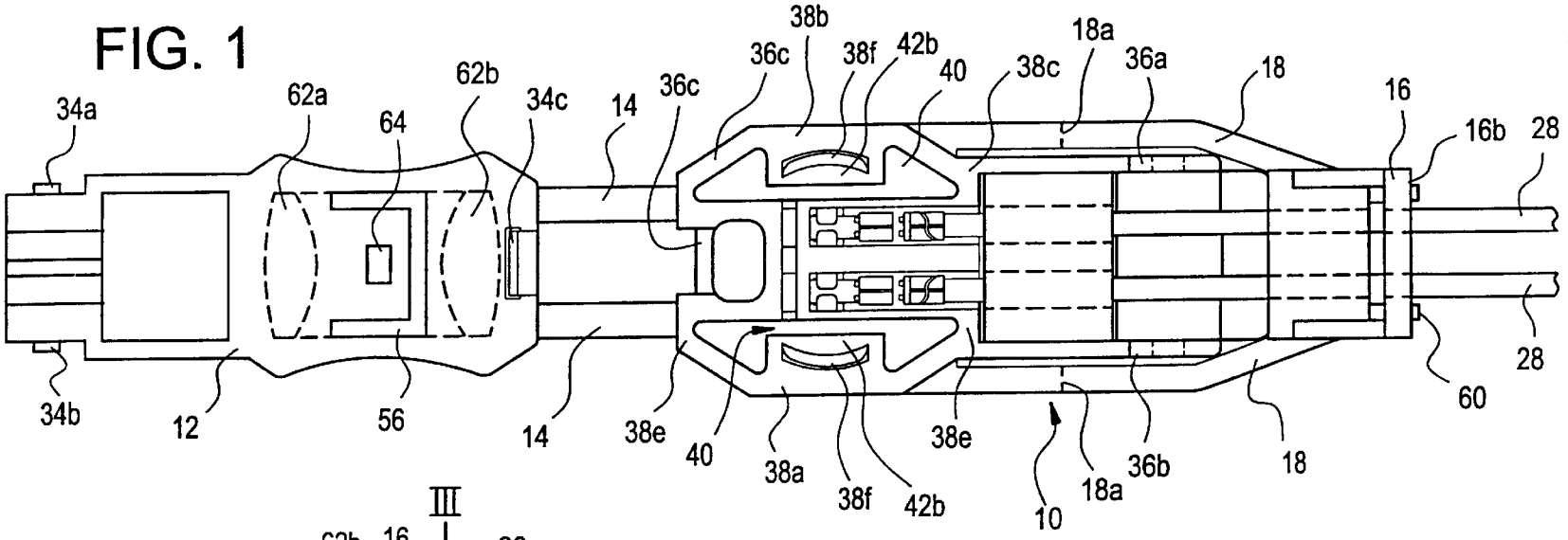
FIG. 1 shows a plan view of a connector according to the invention in the unassembled condition.

The connector illustrated in the figures consists of a lower housing part 10, to which an upper housing part 12 is coupled via straps 14 and a locking element 16 is coupled via straps 18.

Figure 2:
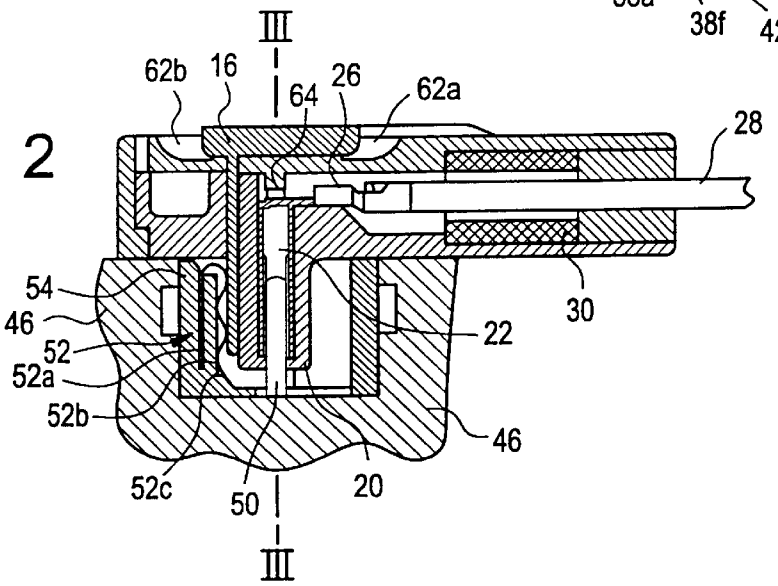
FIG. 2 shows a vertical, longitudinal section through the assembled connector mated with an associated socket.
Figure 3:
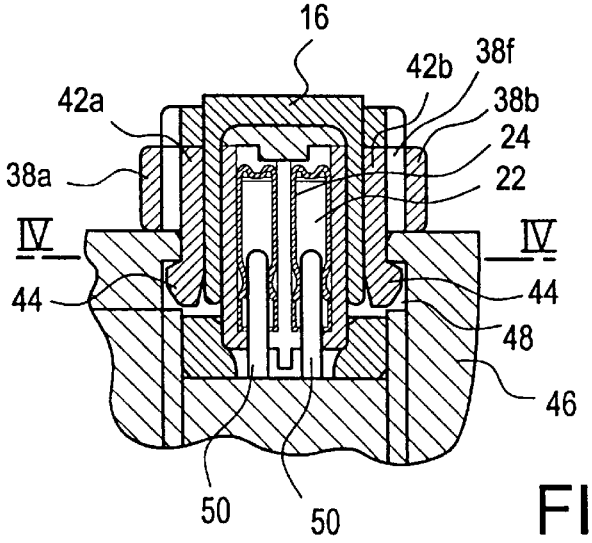
FIG. 3 shows a section along the line III—III of FIG. 2.
Figure 6:
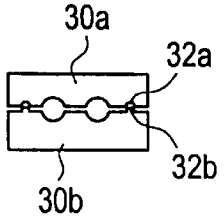
FIG. 6 shows a section through the ferrite core of the connector.

FIGS. 2 and 3 in particular reveal that the lower housing pert 10 is extended at its underside in a nozzle-like (20) fashion. The nozzle 20 has two bores 22 to accept associated contact springs 24, which are connected to associated electric cables 23 via crimp connections 26. The cables 28 are fixed between the lower housing part 10 and the upper housing part 12 and in this case pass through a two-part ferrite core 30 (FIG. 6), the sections 30*a, b,* of the ferrite core 30 being fixed in the upper housing part 12 or the lower housing part 10, respectively, and are directly adjacent to each other (FIG. 6) in the assembled state of the connector (FIG. 2). Slot/spring connections 32*a, b,* at the corresponding face sections of the parts 30*a, b,* of the ferrite core 30 provide wide-area contact and thus the desired electromagnetic compatibility of the connector.

During assembly, the upper housing part 12 is folded over by approximately 180° and locked via locking means 34*a, b, c,* to the lower housing part 10, which has corresponding locking means 36*a, b, c.*

Figure 5:
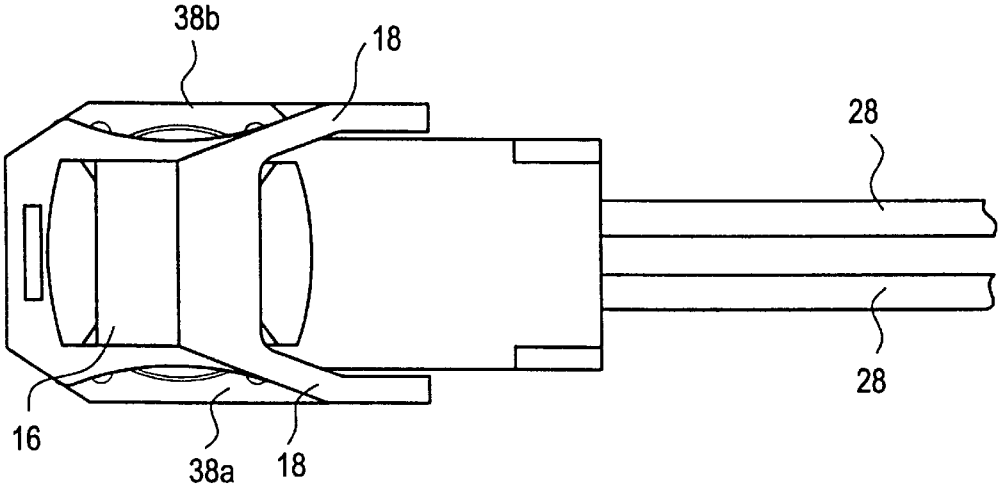
FIG. 5 shows a plan view of the assembled connector.

As FIG. 5 shows in particular, as before, housing sections 38*a, b,* of the lower housing part 10 which include optical openings 38*f* project beyond the attached upper housing part 12. As FIG. 1 shows, these housing sections 38*a, b,* are constructed in the form of a bridge, that is to say connected to the rest of the lower housing part at their end regions 38*e* only, thus forming longitudinal openings 40.

Locking arms 42*a, b* (FIG. 3) with outward-projecting enlargements 44 at the free end regions run parallel from these housing sections 38*a, b,* to the nozzle 20.

To attach the connector to an associated socket 46 with built-in priming cap (trigger device), the connector is inserted via the locking arms 42*a, b,* into a corresponding opening in the socket 46. Since the flexibility of the locking arms 42*a, b,* is only limited, and the external circumference in the region of the enlargements 44 is greater than the diameter of the corresponding opening in the socket 46, the locking arms 42*a, b,* have to be mutually elastically deformed, which, according to the invention, is made possible by the bridge-like elastic housing sections 38*a, b,* for example by pressing them together manually with two fingers. As soon as the connector has reached the desired position in relation to the socket 46, this manual pressure force is removed, so that, the locking arms 42*a, b,* or their enlargements 44, respectively, slip into or behind corresponding cutouts 48 in the socket 46 and secure the connector with respect to the socket 46.

At the same time, when the connector is introduced into the socket 46, contact pins 50 of the socket 46 are guided into the associated contact springs 24.

As before, the contact pins 50 are short-circuited via a short-circuiting link 52, which in this case consists of a leaf spring which is held at one end 52*a* in an insulating ring 54 of the socket 46 (generator) (FIG. 2), and whose spring end interconnects (not shown) the contact pins 50 after being bent back by approximately 180° and offset by approximately 90° at the end.

In the next step, the locking element 16 is now folded over fold line 18*a* of the straps 18 by approximately 180° and inserted through a corresponding opening 56 in the upper housing part 12, connecting link 72 of the locking element 16 pushing away the spring section 52*b* of the short-circuiting link 52 and thus lifting the offset, free end section 52*c* of the short-circuiting spring 52 from the contact pins 50, and cancelling the short-circuiting position. It is important in this case that the short-circuit is only removed when the connector has assumed its definite locking position with respect to the socket 46, which is accomplished by arranging the downwardly extending portion of the locking element in a U-shape (see FIG. 1), with the arms 74*a*,74*b* of the U serving in the locking position to prevent movement of the latch arms 42*a*,42*b*, as shown in FIG. 3, and the connecting link 72 of the U serving to release the short-circuiting link 52, as shown in FIG. 2.

In the assembled position, enlargements 60 on the connecting limb 16*b* of the locking element 16 engage under a bent-up part of the spring section 52*b* of the short circuiting link 52 (also called contact bridge) and thus provide additional locking for the locking element 16.

FIGS. 1 and 2 show two openings 62*a, b,* in the upper housing part 12, which, in the assembled position (FIG. 2), lie both sides of the upper cover of the locking element 16 and thus assist the insertion of a tool to release the locking element 16.

The illustration in FIGS. 2 and 3 shows the function of a projection 64 seen in FIG. 1 on the side of the upper housing part 12 facing the lower housing part 10. In the assembled position (FIGS. 2, 3), this projection 64 presses on the contact springs 24 and therefore additionally holds these in position.

Figure 4:
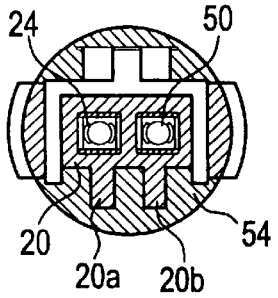
FIG. 4 shows a section along the line IV—IV of FIG. 3.

Finally, the illustration in FIG. 4 shows a modification for the design of the nozzle 20, which in this case is constructed with two separate webs 20*a, b,* projecting radially from the nozzle 20, which lie in corresponding slots in the insulating ring 54 and thus facilitate exact positioning of the parts with respect to each other.

I claim:

1. In an electrical connector, comprising:

a housing for accommodating electrical cables and contact springs connected to the cables, the contact springs being arranged to engage contact pins of an associated socket when the housing is attached to the socket;

spring locking arms on the housing for attaching the housing to the socket, said spring locking arms being arranged to flex is a first direction which enables them to pass into the socket during attachment of the housing to the socket;

a locking element which, after insertion in a corresponding housing opening, secures the locking arms against unintentional release and, in a locking position, releases a short-circuiting link between the contact pins of the socket, the improvement wherein the locking element has a U-shape, the U-shape including locking element arms and a connecting limb, the two locking element arms being positioned adjacent the spring locking arms so as to prevent movement of the spring locking arms when in the locked position, and the connecting limb being positioned between the short-circuiting link and the contacts when the locking element is in the locked position to release the short-circuiting link after insertion of the locking element into the corresponding housing opening.

2. A connector as claimed in claim 1, wherein said locking element has at least one outwardly-protruding enlargement at a free end section of the connecting limb for engaging a corresponding section of the short-circuiting link, said enlargement being arranged to extend between said contact pins.

3. A connector as claimed in claim 1, wherein said short-circuiting link consists of a leaf spring, said leaf spring having one end fixedly secured in an insulating ring of the socket and a free end which interconnects the contact pins after being bent back by approximately 180° and offset by approximately 90° before insertion of the locking element.

4. A connector as claimed in claim 1, wherein said spring locking arms on the housing are offset by approximately 90° with respect to said connecting limb.

5. A connector as claimed in claim 1, where the spring locking arms depend from housing sections which are arranged to flex in said first direction to assist the spring locking arms to pass into the socket during attachment of the housing to the socket.

6. A connector as claimed in claim 5, wherein said flexible housing sections are in the form of arms, said arms having end regions connected to a remainder of said housing at corresponding end regions only such that portions of said arms are unconnected to the remainder of the housing and therefore free to move in said first direction relative to the remainder of the housing as said locking arms are inserted into said opening in said socket.

7. A connector as claimed in claim 6, wherein said arms have two ends and are connected by said end regions to a remainder of said housing at one of said two ends only.

8. A connector as claimed in claim 5, wherein said flexible housing sections extend on two sides of the housing and extend generally parallel to the electrical cables.

9. A connector as claimed in claim 1, wherein the housing comprises first, second, and third housing parts: a lower first housing part to accommodate the contact springs, an upper second housing part to cover the lower housing part and to localize the electrical cables between the upper and lower housing part, and a locking element that can be led through a corresponding opening in the upper housing part, said locking element being the third housing part.

10. A connector as claimed in claim 8, wherein the upper housing part, the locking element, or both the upper housing part and the locking element are connected to the lower housing part via flexible straps.

11. A connector as claimed in claim 8, wherein the upper housing part has a projecting section protruding toward the lower housing part and engaging an upper end of the contacts springs in an assembled position.

12. A connector as claimed in claim 8, wherein the upper housing part has at least one opening adjacent the locking element.

13. A connector as claimed in claim 8, wherein the lower first housing part is a nozzle and has at least one radially-projecting web for engagement in a correspond slot in the socket.

* * * * *

UNITED STATES PATENT AND TRADEMARK OFFICE

CERTIFICATE OF CORRECTION

PATENT NO. : 5,827,083

DATED : October 27, 1998

INVENTOR(S) : DULLIN

It is certified that error appears in the above-identified patent and that said Letters Patent is hereby corrected as shown below:

Column 1, line 18, change "10" to --1.0--.

Column 3, line 52, change "pert" to --part--.

line 55, change "23" to --28--.

Signed and Sealed this

Thirteenth Day of April, 1999

*Attest:*

Q. TODD DICKINSON

*Attesting Officer*

*Acting Commissioner of Patents and Trademarks*